US005139417A

United States Patent [19]

Ghassemzadeh

[11] Patent Number: 5,139,417

[45] Date of Patent: Aug. 18, 1992

[54] GAS BURNER WITH IMPROVED PRIMARY PORT ARRANGEMENT

[75] Inventor: Reza Ghassemzadeh, Louisville, Ky.

[73] Assignee: General Electric Company, Louisville, Ky.

[21] Appl. No.: 643,848

[22] Filed: Jan. 22, 1991

[51] Int. Cl.[5] ..... F23D 14/62

[52] U.S. Cl. ..... 431/354; 126/39 R; 126/39 H; 239/556; 239/561; 239/568

[58] Field of Search ..... 126/39 E, 39 R, 39 H, 126/39 K; 431/354, 266, 355, 343, 195, 154; 239/554, 556, 560, 561, 568, 601

[56] References Cited

U.S. PATENT DOCUMENTS

| | | | |
|---|---|---|---|
| 2,638,976 | 5/1953 | Vixler | 431/346 |
| 2,691,414 | 10/1954 | Ponstingl | 431/346 |
| 2,843,199 | 7/1958 | Brodbeck et al. | 431/346 |
| 3,301,311 | 1/1967 | Stohrer, Jr. et al. | 239/567 |
| 3,817,689 | 6/1974 | Capy | 431/349 |
| 3,858,811 | 1/1975 | Mizerak et al. | 239/553.3 |
| 4,527,539 | 7/1985 | Kay | 126/39 R |
| 4,626,196 | 12/1986 | Stohrer, Jr. | 126/39 E |
| 4,810,188 | 3/1989 | Kwiatek | 431/266 |

FOREIGN PATENT DOCUMENTS

| | | | |
|---|---|---|---|
| 1429134 | 9/1969 | Fed. Rep. of Germany . | |
| 3013326 | 10/1980 | Fed. Rep. of Germany . | |
| 796167 | 6/1958 | United Kingdom . | |
| 955615 | 4/1964 | United Kingdom | 126/39 H |
| 967781 | 8/1964 | United Kingdom | 126/39 H |

*Primary Examiner*—James C. Yeung

*Attorney, Agent, or Firm*—H. Neil Houser; Radford M. Reams

[57] ABSTRACT

An improvement to conventional atmospheric gas burners particularly advantageously applied to the type used as surface heating units in gas cooking appliances such as ranges and cooktops, which typically comprise a burner head having a plurality of primary burner ports formed at port locations equally spaced about the periphery of the burner head. Improvement is realized by not forming primary burner ports at selected ones of the equally spaced port locations. The unused port locations are selected so as to separate the primary ports into groups. The reduction in the number of ports reduces the total port area thereby reducing the amount of primary air entrained in the air/gas mixture delivered to the burner. In addition the resulting spacing of the groups of ports has the effect of reducing the amount of secondary air per port relative to that which would be entrained by the same number of ports, if equally distributed about the periphery. The net result being more controlled combustion under normal operating conditions and in particular under delayed ignition conditions.

10 Claims, 1 Drawing Sheet

GAS BURNER WITH IMPROVED PRIMARY PORT ARRANGEMENT

BACKGROUND OF THE INVENTION

This invention relates to atmospheric gas burners.

In conventional atmospheric gas burners, such as are used as surface units in ranges and cooktops, the main burner ports are generally of uniform size and shape and equally spaced around the periphery of the burner head. Examples of such burners are shown in U.S. Pat. Nos. 4,810,188, 3,301,311, and 3,817,689.

A problem which an occur with such burners, particularly when employed in so-called spill-proof or sealed gas burner arrangements (referring to the lack of an opening in the cooktop surface around the base of the burner to prevent spillage of food soils into the area beneath the cooktop) is that delayed ignition with a utensil in position over the burner can result in an uncontrolled combustion phenomenon characterized by a large flame envelope and shock waves accompanied with an objectionably high level of noise. Additionally, under normal operating conditions when the burner is adjusted to certain heat settings, typically a relatively low setting, the flame stands close to the burner resulting in potentially excessive burner head temperatures which in extreme instances could melt the burner.

A burner having a portion arrangement which varies from the conventional uniform port size arrangement of the aforementioned patents, is disclosed in British Patent Specification 796,167 published Jun. 4, 1958. In this burner the ports are equally spaced but different port sizes are employed to control the physical size of the flame. In particular, smaller ports are employed to provide starter flames in the areas proximate the pan support grid to avoid or limit impingement of the flame on the grid, to avoid quenching of the flame and the higher CO emissions associated with such quenching. However, such an arrangement does not address either the aforementioned uncontrolled combustion problem or the high temperature problem.

It is therefore a primary object of the present invention to provide an improved gas burner for surface cooking appliances, which alters the combustion process so as to yield slower and more controlled combustion under delayed ignition conditions without compromising stable combustion and satisfactory emission performance under normal operating conditions.

It is a further object of the invention to provide an improved burner of the aforementioned type which contributes to lower burner operating temperatures at the lower heat settings.

It is a further object of the invention to provide an improved gas burner of the aforementioned type which does not add substantially to the cost or structural complexity of conventional burners.

SUMMARY OF THE INVENTION

The present invention provides an improvement to conventional atmospheric gas burners which is particularly advantageously employed with such burners used as surface heating units in gas cooking appliances such as ranges and cooktops and particularly appliances with so-called sealed gas burners. Such burners typically comprise a burner head normally having a pluralit of primary burner ports formed at port locations equally spaced about the periphery of the burner head.

In one preferred form of the invention, improvement over conventional burner designs is realized by not forming primary burner ports at selected ones of the equally spaced port locations. The unused port locations are selected so as to separate the primary ports into groups. The reduction in the number of ports reduces the total port area thereby reducing the amount of primary air entrained in the air/gas mixture delivered to the burner. In addition the resulting spacing of the groups of ports has the effect of reducing the amount of secondary air per port relative to that which would be entrained by the same number of ports, if equally spaced about the periphery. The net result is more controlled combustion under normal operating conditions and in particular under delayed ignition conditions. In addition, the flame pattern tends to stand further from the burner thereby resulting in cooler burner temperatures under normal operating conditions.

In accordance with another preferred form of the invention in a burner of the aforementioned type having primary ports of substantially uniform port area formed at equally spaced port locations, the improvement comprises forming at selected ones of the port locations in lieu of a primary port, a port having a substantially smaller port area than the primary ports. The port locations for the small ports are selected so as to separate the primary ports into groups of primary ports. This form of the invention does no reduce the primary air to the same extent as the previously described form and thus may be slightly less effective in limiting noise and flame roll-out, but still controls this phenomena within acceptable limits providing a significant improvement over conventional burners. This form of the invention provides a more visually appealing flame pattern, more effective cross-lighting, and permits the use of a shorter grate resulting in greater energy efficiency.

While the novel features of the invention are set forth with particularity in the appended claims, the invention will be better understood and appreciated from the following detailed description of certain preferred embodiments taken in conjuncation with the drawings.

DETAILED DESCRIPTION OF ILLUSTRATIVE EMBODIMENT

Figure 1:
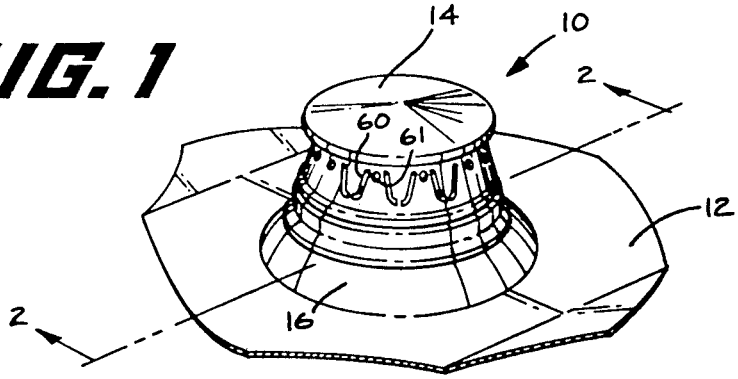
FIG. 1 is a perspective view of a portion of a range top including a gas burner embodying the present invention.
Figure 2:
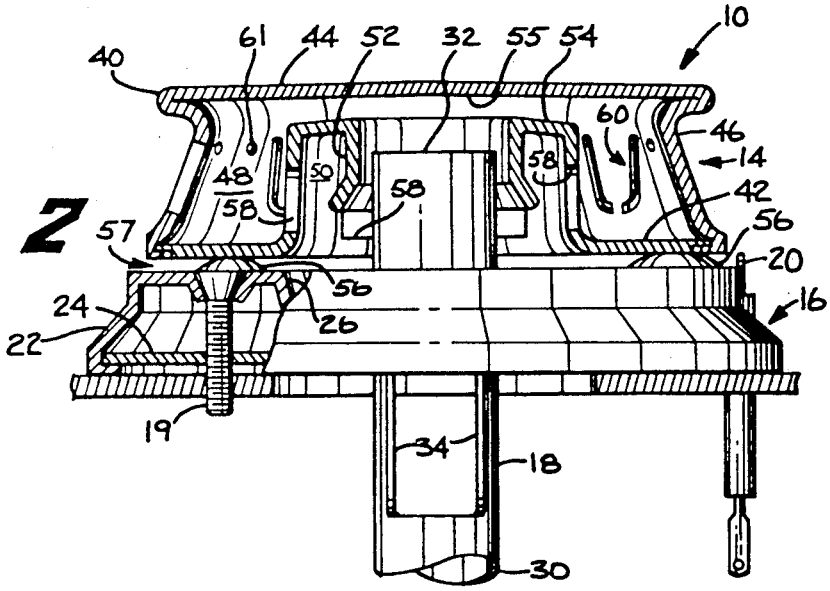
FIG. 2 is a sectional view of the burner of FIG. 1 taken along lines 2—2.

Referring now primarily to FIGS. 1 and 2, there is shown an atmospheric gas burner assembly embodying the present invention and designated generally 10. Burner assembly 10 is shown supported from a portion of the support surface 12 of a cooking appliance such as a range or cooktop. Burner assembly 10 includes a burner head 14, base 16 and gas injection tube 18. When fully assembled, burner head 14 removably rests on a base 16 which is secured to the support surface 12 by three screws 19 circumferentially spaced around the upper surface of base 16, one of which is shown in FIG.

2. A spark ignition electrode 20 is supported from base 16.

Base 16 is of two piece construction, including a mainb ase member 22 and bottom plate 24. Main base member 22 is shaped to form a hollow open bottomed annular ring about central opening 26. Plate 24 provides the bottom wall of base 16 and supports injection tube 18 within the burner. Injection tube 18 is suitably secured in a closely fitting opening (not shown) in plate 24 coaxially aligned with central opening 26. Injection tube 18 at its lower end 30 attaches to a gas supply orifice (not shown). The upper end 32 of tube 18 projects upwardly through base 16 into burner head 14. The wall of tube 18 is slotted at 34 to admit primary air into the tube for mixing with the gas from the orifice.

Burner head 14 is also of two piece construction including an upper member 40 and a bottom member 42. Upper member 40 is generally in the shape of an inverted cup to provide a generally flat top surface 44 for the burner and slightly tapered outer side wall 46. Bottom member 42, provides the bottom wall for burner head 14, combining with top member 40 to form an annular primary mixing chamber 48, and together with the injection tube and base forms an annular secondary mixing chamber 50. At its central region bottom member 42 is shaped to provide a downwardly extending central collar 52 to receive the upper end 34 of injection tube 18. The annular surface 54 proximate the base of collar 52 is shaped to radially diverge from the inner face 55 of top surface 44 to provide an annular venturi for the air gas mixture entering the burner head.

When fully assembled, collar 52 fits over the upper end 34 of injection tube 18 with the bottom surface of bottom plate resting on embossments 56 formed on the upper surface of base 16 proximate the openings for screws 18 and proximate the igniter 20. Embossments 56 space the bottom member 42 from the upper surface of upper base member 22 to provide an annular flame retention gap at 57 between base 16 and burner head 14.

The air/gas mixture enters burner head 14 from injection tube 18, and passes through the annular venturi region into primary mixing chamber 48. A portion of the mixture passes through openings 58 into the secondary mixing chamber 50 from which it extis via the flame retention gap 57. However, the major portion of the air/gas mixture exits primary mixing chamber 48 via primary ports 60 formed in outer side wall 46 of burner head 14 with some also passing through small holes 61 which are provided primarily for flame retention and to enhance cross-lighting at ignition.

Primary air to support combustion is drawn from beneath support surface 12 and is entrained in conventional fashion through slots 34 in injection tube 18. As best seen in FIG. 1, burner 10 is arranged as a so-called sealed burner. This refers to there being no opening through appliance support surface 12 around the base of burner assembly 10. Thus the area beneath the cooking surface is sealed off to prevent spills from entering the area underneath the support surface. Consequently, secondary air for combustion at the primary ports as well as the flame retention gap 57 is drawn from above the cooking appliance support surface rather than from the area beneath this surface.

Under certain conditions, such burners may be subject to objectional noise and flame roll-out in the event ignition is delayed. This is particularly a problem with the relatively heavier propane gas, but may be also of concern with natural gas. Such a phenomenon is particularly likely to occur if the burner is cold, a pan is in position over the burner and there is no significant air movement in the vicinity of the burners. When ignition is delayed under such conditions, the cold burner, pan and lack of air movement combine to limit the dissipation of the air/gas mixture being released from the burner, which consequently collects in the burner well formed in the cooking surface around the burners. When ignition occurs several seconds later, a sudden enlarged envelope of flame with accompanying shock waves and an objectionably loud noise can result. Representatively, as an indication of the order of magnitudes involved, the flame envelope can completely engulf the utensil and the noise can be on the order of 95 dbA. It will be appreciated that both the flame envelope and the noise can vary considerably from these representative values depending upon the time delay, the size of the utensil and other variables.

Typically such burners have primary ports formed at port locations equally spaced about the periphery of the burner head. As will be hereinafter described in greater detail, in accordance with the present invention this problem can be avoided by appropriately altering the number and spacing of primary ports about the periphery of the burner head. A further advantage resulting from such spacing is cooler burner operating temperatures.

As used herein, the term port shall be understood to refer to one or more apertures which cooperate to support what visually appears as a single joint or jet of flame. As best seen in FIGS. 1 and 3, the primary ports 60 in the illustrative embodiments herein described each consist of a v-shaped opening formed by a pair of converging elongated slots only slightly separated at the bottom of the V. Separate slots rather than a single v-shaped continuous slot are used to form the primary ports in the present embodiment for ease in manufacturing. Functionally a single v-shaped slot could be similarly employed. In addition other configurations of two or more apertures could be combined to function as a single port, provided the exiting gases merge to support a what visually appears as a single point of flame.

Figure 3A:
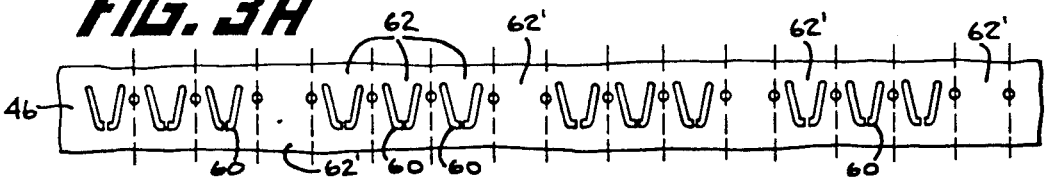
FIGS. 3A, 3B and 3C are fragmentary planar representations of that portion of the circumferential outer wall of the burner of FIG. 1 containing the gas ports, illustrating the port distribution patterns for alternate embodiments of the burner in accordance with the invention.
Figure 3B:
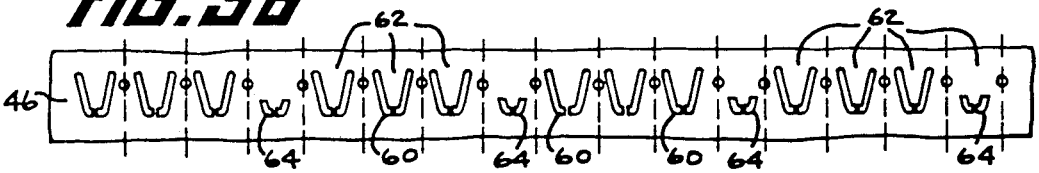
Figure 3C:
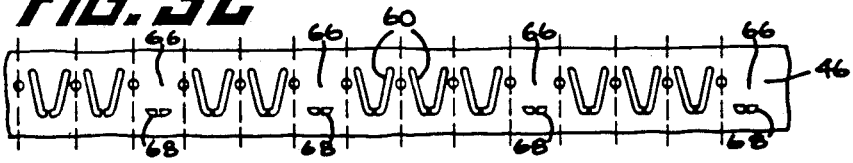

FIGS. 3A-3C illustrate in a flat plane that portion of the circumferential side wall 46 of burner head 14 containing ports 60. Referring now particularly to FIG. 3A, the periphery of what would conventionally be a 2½ inch diameter, 10,000 BTU burner with sixteen ports is shown in planar representation, modified in accordance with the present invention. The side wall 46 of burner head illustrated in FIG. 3A is separated into sixteen equally spaced primary port locations designed 62 by dotted lines. In the conventionally designed version of the burner of this embodiment, each such location contains a primary port 60. Each primary port 60 has a nominal port area of about 14 $mm^2$. Such a port arrangement was found to be prone to the uncontrolled combustion phenomena hereinbefore described under delayed ignition conditions as well as excessively high burner temperatures sufficient in some instances to partially melt the burner head.

The foregoing problems are overcome in accordance with the present invention as embodied in the burner represented in FIG. 3A by not providing a primary port at selected ones of the port locations 62. In this embodiment port locations designed 62' were not used for primary ports. The unused port locations separate the primary ports into groups of three ports, with each group separated from adjacent groups by an unused port location. The resulting groups of ports are separated by a distance which is approximately twice the center to center distance between ports within the groups.

This change, by reducing the total port area of burner 14 by about 25%, reduces the amount of entrained primary and secondary air as would be expected. In addition, the amount of secondary air drawn to each port, that is, the amount of inflowing air which replaces the air entrained by the gaseous mixture as it extis the ports, is affected by the port pattern. Grouping of the ports in accordance with the present invention reduces the amount of secondary air per port, relative to the amount of secondary air which would be drawn to each port if the same reduced number of ports were equally spaced around the periphery of the burner head. This grouping of ports is critical to controlling the flame roll-out and noise phenomenon. In this embodiment the flame envelope associated with the delayed ignition phenomenon does not extend beyond the periphery of the utensil and the noise is reduced from levels on the order of 95 dbA to 72 dbA. A burner having exactly the same design parameters except with equally spaced ports consistently demonstrated flame roll-out and noise beyond acceptable limits.

While the embodiment of FIG. 3A satisfactorily controls the noise and flame roll-out phenomenon, there are trade-offs. The resulting steady state flame pattern is less visually appealing than that of the conventional burner due to the gaps between groups of ports. In addition cross-lighting of the primary ports during ignition while satisfactory is somewhat slower than with the conventional design. Finally, the reduction in port area due to the corresponding reduction in primary air being entrained required that a somewhat taller grate be used to assure compliance with applicable regulatory standards regarding carbon deposits. The impact of these trade-offs can be lessened without unduly compromising the solution to the original problem by the port arrangement of the alternative embodiment illustrated in FIG. 3B.

As in FIG. 3A, the side wall of the burner is divided into sixteen equally spaced primary port locations, with primary ports 60 separated into groups of three by the selected port locations. In this embodiment, however, small ports 64 each having a port area reduced to a small fraction on the order of 20% of that of primary ports 60 are provided at the selected port locations. In particular, each of ports 64 has a port area of approximately 3 $mm^2$. This port arrangement provides a more aesthetically pleasing flame pattern and enhances cross lighting, while sufficiently controlling combustion during delayed ignition conditions to maintain onise and flame roll-out within acceptable limits. In addition, the increase in primary aeration resulting from the additional port area provided by small ports 64 enables compliance with sooting requirement using a shorter grate. The flame envelope associated with such phenomenon increased only slightly and the typical noise level increased from 72 dbA to 74 dbA.

FIG. 3C represents a port arrangement for a smaller 2 inch diameter, 7500 BTU burner which conventionally would have had fourteen primary ports. The port area of the individual ports is the same as for the 2½ inch diameter burner. The dotted lines divide the burner side wall into fourteen equally spaced port locations. In this embodiment the selected port locations not containing primary ports, designated 66, divide the primary ports 60 into two groups of two primary ports and two groups of three primary ports. Preferably the resulting groups are arranged as shown with the groups of like nubmers of ports next to each other. As in the embodiment of FIG. 3B, the selected port locations are provided with smaller ports 68 of greatly reduced port area. In this embodiment ports 68 are on the order of 2 $mm^2$. It will be appreciated that a port configuration in which the selected port locations contain no ports at all, analogous to the embodiment of FIG. 3A, could also be similarly employed for the smaller burner as well.

An additional benefit of the improvements illustrated in the embodiments of FIG. 3A–3C is that with the primary ports grouped together as in these embodiments, the flame pattern tends to stand further form the burner head 14 than is the case with ports equally spaced about the entire periphery. This increased spacing of the flame from the burner lowers the operating temperature of the burner sufficiently to prevent the hereinbefore described melting problem.

While in accordance with the Patent Statutes, specific embodiments of the present invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. In an atmospheric gas burner for use as a surface heating unit in a gas cooking appliance of the type including a burner head normally having a plurality of primary burner ports, each port comprising one or more apertures which cooperate to support what visually appears as a single point of flame for each port, the ports being formed at port locations equally spaced about the periphery of the burner head, the improvement wherein primary burner ports are not formed at selected ones of the port locations, so as to separate the primary ports into groups, each such group being separated from adjacent groups by one of said selected port locations, and wherein each fo said selected port locations is separated from every other selected port location by a group of primary ports, each group comprising at least two and not more than three primary ports, whereby better controlled combustion is provided under normally encountered operating conditions.

2. The improvement of claim 1 wherein the primary ports are separated by said selected port locations into at least four groups, two of which comprise two primary ports each and two of which comprise three primary ports each.

3. The improvement of claim 1 wherein said groups include at least one group of two primary ports and at least one group of three primary ports.

4. In an atmospheric gas burner for use as a surface heating unit in a gas cooking appliance of the type including a burner head normally having a plurality of primary burner port locations equally spaced about the periphery of the burner head, each location normally ahving formed thereat a primary port, ech primary port comprising one or more apertures which cooperate to support what visually appears as a single point or jet of flame for each port, each of such primary ports being of substantially uniform port area, the improvement wherein selected ones of the port locations have formed thereat in lieu of a primary port, a port also comprising one or more apertures which cooperate to support what visually appears as a single point or jet of flame for each port, but having a port area substantially smalelr than a primary port, so as to separate the primary ports into groups, each such group being separated from adjacent groups by at least one port location containing one of said substantially smaller ports, and wherein each of said port locations containing a smaller port is separated form every other such port location by at least two primary ports, whereby better controlled combustion is provided under normally encountered operating conditions while retaining a cross-lighting capability and aesthetic appearance like that of conventional burners.

5. The improvement of claim 4 wherein each group of primary ports comprises at least three primary ports.

6. The improvement of claim 4 wherein the locations containing the primary ports are separated by locations containing said smaller ports into at least four gruops, two of which comprise two primary ports each and two of which comprise three primary ports each.

7. The improvement of claim 4 wherein said groups comprise at least one group of two primary ports and at least one group of three primary ports.

8. An improved burner head for an atmospheric gas burner of the type having primary ports formed in the burner head, wherein each port comprises one or more apertures which cooperate to support what visually appears as a single point or jet of flame for each port, and said ports are distributed about the periphery of the burner head in groups, with the spacing between each of said groups being greater than the center to center distance between ports within said groups and wherein each group comprises at least two and not more than three primary ports.

9. The burner head of claim 8 wherein the distance between said groups is at least approximately twice the center to center distance between ports within said groups.

10. The burner head of claim 8 wherein a port of greatly reduced port area relative to that of said primary ports is located in the space between groups of primary ports.

* * * * *